United States Patent [19]

Reinehr et al.

[11] 4,332,765

[45] Jun. 1, 1982

[54] PROCESS FOR SPINNING HYDROPHILIC ACRYLIC FIBRES OF LOW DENSITY

[75] Inventors: Ulrich Reinehr; Toni Herbertz, both of Dormagen; Hermann-Josef Jungverdorben, Grevenbroich, all of Fed. Rep. of Germany

[73] Assignee: Bayer Aktiengesellschaft, Leverkusen, Fed. Rep. of Germany

[21] Appl. No.: 82,449

[22] Filed: Oct. 9, 1979

Related U.S. Application Data

[62] Division of Ser. No. 962,959, Nov. 22, 1978, abandoned.

[30] Foreign Application Priority Data

Nov. 26, 1977 [DE] Fed. Rep. of Germany ..... 2752821

[51] Int. Cl.[3] ..... D02G 3/00

[52] U.S. Cl. ..... 264/206; 264/211

[58] Field of Search ..... 264/206, 211, 63

[56] References Cited

U.S. PATENT DOCUMENTS

| | | | |
|---|---|---|---|
| 1,959,443 | 5/1934 | Payne et al. | 264/63 |
| 1,996,753 | 4/1935 | Dreyfus et al. | 264/207 |
| 2,032,606 | 3/1936 | Whitehead | 264/63 |
| 2,425,782 | 8/1947 | Bludworth et al. | 264/63 |
| 4,163,078 | 7/1979 | Reinehr et al. | 264/182 |
| 4,185,058 | 1/1980 | Reinehr et al. | 264/206 |
| 4,185,059 | 1/1980 | Reinehr et al. | 264/206 |
| 4,224,269 | 9/1980 | Reinehr et al. | 264/206 |
| 4,239,722 | 12/1980 | Reinehr et al. | 264/206 |

FOREIGN PATENT DOCUMENTS

| | | | |
|---|---|---|---|
| 740 | 2/1979 | European Pat. Off. | 264/206 |
| 2713456 | 4/1978 | Fed. Rep. of Germany | 264/206 |

*Primary Examiner*—Jay H. Woo

*Attorney, Agent, or Firm*—Sprung, Horn, Kramer & Woods

[57] ABSTRACT

The invention relates to dry-spun hydrophilic core-jacket filaments or fibres of a hydrophobic filament forming synthetic polymer. The filaments or fibres having a porosity of at least 50%, a water-retention capacity of at least 100% and a mercury density of at most 0.7 g/cm$^3$. The invention also relates to a process for the production of these fibres and filaments.

3 Claims, No Drawings

PROCESS FOR SPINNING HYDROPHILIC ACRYLIC FIBRES OF LOW DENSITY

This is a division of application Ser. No. 962,959, filed Nov. 22, 1978 and now abandoned.

According to German Offenlegungsschrift No. 2,554,124, hydrophilic filaments and fibres can be obtained from filament-forming synthetic polymers by adding to the spinning solvent from 5 to 50% by weight, based on solvent and solids, of a substance which is essentially a non-solvent for the polymer, which has a higher boiling point than the solvent used and which is readily miscible both with the spinning solvent and with a liquid suitable for washing the filaments, and subsequently washing this non-solvent out of the filaments produced. In this process, preferred non-solvents are polyhydric alcohols such as glycerol, sugars and glycols.

Fibres such as these spun, for example, from acrylonitrile polymers have a core-jacket structure and a water-retention capacity of at least 10%.

It has now surprisingly been found that the water retention capacity of hydrophilic filaments or fibres of the type in question can be increased far beyond 100% to about 300% by increasing the proportion by weight of non-solvent added to such an extent that the ratio by weight of polymer solids to the non-solvent amounts to at most about 2.0:1 and, with advantage, to 1:1 and by carrying out spinning in the additional presence of steam or the vapour of any other liquid which coagulates the filaments.

Accordingly, the present invention provides a process for the production of hydrophilic low-density filaments or fibres having a core-jacket structure from hydrophobic filament-forming synthetic polymers by dry spinning, in which there is added to the spinning solvent a substance which (a) has a higher boiling point than the spinning solvent used, (b) is readily miscible with the spinning solvent and with water, and (c) is a non-solvent for the polymer to be spun, characterised in that, immediately on leaving the spinning jet, but at the latest at a time at which they have still not completely hardened, the filaments are brought into contact with steam, or with the vapour of any other liquid which coagulates the filaments, at duct temperatures of at most 140° C., and in that the ratio by weight of polymer solids to non-solvent amounts to at most about 2:1.

The invention also provides dry-spun hydrophilic corejacket filaments or fibres of hydrophobic, filament-forming synthetic polymers having a porosity of at least 50%, a water retention capacity of at least 100% and a mercury density of at most 0.7 g/cc.

By virtue of their high water-retention capacity and their high porosity, filaments or fibres of this type have an extremely low fibre density.

Polymers which are normally hydrophobic, i.e. polymers with a water uptake of around 8% or less, preferably acrylonitrile polymers and, with particular preference, acrylonitrile polymers containing at least 50% by weight and, more particularly, at least 85% by weight of acrylonitrile units, are spun by the process according to the invention. The process according to the invention may also be used for the production of two-component or modacrylic fibres, fibres of homopolymers, spun-dyed fibres or even fibres of polymer blends, for example of mixtures of acrylonitrile polymers and polycarbonates. It is also possible in accordance with the invention to use linear aromatic polyamides, such as for example the polyamide of m-phenylene diamine and isophthalic acid, or polyamides which optionally contain heterocyclic ring systems, such as for example benzimidazoles, oxazoles or thiazoles, and which can be obtained by dry spinning from a spinning solution with a solvent to be evaporated.

In principle, the spinning process is a conventional dry spinning process, preferably from strongly polar organic solvents, such as dimethyl formamide, dimethyl acetamide and dimethyl sulphoxide. In addition to water, preferred non-solvents for the spun acrylonitrile polymers are monosubstituted and polysubstituted alkyl ethers and esters of polyhydric alcohols, such as diethylene glycol, triethylene glycol, tripropylene glycol, tetraethylene glycol and glycol ether acetates. Other suitable non-solvents are alcohols, such as glycerol, esters or ketones, or even solids such as sugar, urea, salts or organic acids.

Depending upon the point at which and the intensity with which the vapour is blown onto the polymer filaments and upon the thermal conditions prevailing in the spinning duct, it is possible to control both the cross-sectional structure and also the width of the jacket surface and the hydrophilic properties and, hence, the pore volume and density of the filaments.

It has been found that core-jacket fibres having a water retention capacity of greater than 100% and fibre densities of less than 0.7 g/cc are always obtained when spinning is carried out at low duct temperatures of at most 140° C.

In order to avoid excessive condensation of water vapour and solvent mixtures in the spinning duct, a duct temperature above 100° C. and preferably in the range of from 105° to 125° C. has proved to be optimal.

Where higher duct temperatures, particularly above 160° C., are applied, distinctly lower water retention values of about 20 to 60% and higher fibre densities normally amounting to more than 0.7 g/cc are obtained.

Any increase in the amount of vapour used produces an increase in the hydrophilicity of the fibres and a reduction in their density (cf. Table I).

The cross-sectional structure of the core-jacket fibres was determined from photographs taken with an electron microscope.

In the process according to the invention, the vapour is preferably blown in above the spinning jet in the air-flow and filament take-off direction. However, the vapour may also be blown in below the spinning jet transversely of the filaments provided that not excessive turbulence is generated in this way.

In principle, the non-solvent vapours, preferably water vapour, may be left in contact with the filament material for as long as the filament material is still soft, i.e. has not completely hardened. For example, the action of water vapour by means of a jet immediately after the group of filaments has left the spinning duct also leads to excessively hydrophilic porous core-jacket fibres.

However, it is preferred to carry out the spinning process in a pure water vapour atmosphere. The minimum quantity of water vapour blown in which is required to product hydrophilic core-jacket fibres having a water retention capacity of greater than 100% amounts to approximately 1.5 kg per kg of spun material at a duct temperature of 105° C. starting from a mixing ratio of polymer to non-solvent of about 1.3:1 in a polyacrylonitrile spinning solution having a concentration of 22.5% by weight. Where mixtures of water vapour and air are used during spinning, the quantity of water vapour has to be increased accordingly in order to obtain high water retention capacities and hence low densities of less than 0.7 g/cc, because by adding air the vapour medium only comes into contact with the filaments in a correspondingly relatively dilute form. However, once formation of the core-jacket structure has progressed beyond the initial stage, spinning air may of course be introduced during the actual spinning process, for example in the spinning duct below the spinning jet, without any significant change in the porosity of the filaments.

In the case of acrylic fibres, for example, densities of less than 0.5 g/cc are obtained, depending upon the quantity by weight of non-solvent added and upon the quantity in which and the intensity with which the water vapour is added, whereas conventional acrylic fibres have density values at least twice as high.

Filaments or fibres obtained by the process according to the invention have a cottonwool-like appearance and a bulky feel. They are eminently suitable for use in the production of self-absorbing materials and tampons and may be used, for example, for hygienic articles and for the removal of liquid pollutants from refuse dumps. The filaments or fibres are also suitable for lint and bandaging purposes. By virtue of their low density coupled with their high hydrophilicity, fibres and filaments of the type in question are also of considerable interest in applications where wearing comfort needs to be coupled with lightness of weight, for example for clothing purposes in space and air travel.

The physical values mentioned above were determined as described in the following. These methods relate to dyed and blank-dyed preparation-free fibres, yarns or sheet-form textiles.

METHODS

Mercury density determination ($\rho$ Hg)

After the sample has been heated in vacuo ($10^{-2}$ mbar) at a temperature of 50° C., the Hg-density (mean apparent density) is determined by volume measurements in mercury under an excess pressure of 10 bars.

Helium density determination ($\rho$ He)

After the sample has been heated in vacuo ($10^{-2}$ bars) at a temperature of 50° C., the helium density ("true density") is determined by volume measurements in helium using a gas comparison pyknometer.

Definition of porosity (P)

$$P=[1-(\rho Hg/\rho He)]\cdot 100\%$$

Determination of water retention capacity (WR)

The water retention capcity is determined in accordance with DIN 53 814 (cf. Melliand Textilberichte 4 1973; page 350).

The fibre samples are immersed for 2 hours in water containing 0.1% of a wetting agent. The fibres are then centrifuged for 10 minutes with an acceleration of 10,000 m/sec$^2$ and the quantity of water retained in and between the fibres is gravimetrically determined. In order to determine their dry weight, the fibres are dried at 105° C. until constant in weight. The water retention capacity (WR) in % by weight is:

$$WR=(m_f-m_{tr}/m_{tr})\times 100$$

$m_f$=weight of the moist fibres $m_{tr}$=weight of the dried fibres.

The invention is illustrated by the following Examples in which the parts and percentages quoted are by weight unless otherwise indicated.

EXAMPLE 1

60 kg of dimethyl formamide were mixed with 17.5 kg of tetraethylene glycol at room temperature in a vessel. 22.5 kg of an acrylonitrile copolymer were then added with stirring (chemical composition of the acylonitrile polymer: 93.6% of acylonitrile, 5.7% of methyl acrylate and 0.7% of sodium methallyl sulphonate). The ratio by weight of polymer solids to non-solvent amount to 1.3:1. The suspension which had a polymer solids content of 22.5% by weight was delivered by a gear pump to a heating unit where it was heated to 130° C. The residence time in the heating unit amounted to 3 minutes. The spinning solution was then filtered and directly delivered to a 380-bore spinning jet. 40 kg/h of saturated water vapour were blown into the spinning duct above the spinning jet. The duct temperature was 105° C. Approximately 6.5 kg of water vapour were consumed per kg of spun material produced. The filaments with an overall denier of 2280 dtex were collected on bobbins and combined to form a tow having a denier of 285,000. The tow was then drawn in a ratio of 1:4.0 in boiling water, washed, provided with an antistatic preparation, dried at 120° C., crimped and cut into 60 mm long staple fibres. The individual fibres had a final denier of 2.2 dtex and a water retention capacity according to DIN 53 814 of 192%. The fibres had a pronounced core-jacket structure with an oval cross-section.

The individual fibres had a helium density of 1.18 g/cc and a mercury density of 0.407 g/cc. Their porosity amounted to 65.5%.

Further Examples are summarised in Table I below. The spinning solutions were spun into core-jacket fibres having a final denier of 2.2 dtex and after-treated in the same way as described in Example 1. The quantities of water vapour and air used and also the air and duct temperatures prevailing during the spinning process were varied. The polymer described above was used as the solid in the ratios by weight indicated. Tetraethylene glycol was used as the non-solvent.

TABLE I

| No. | Quantity of water vapour in kg per kg of spun material | Quantity of air (m$^3$/h) | Air temperature °C. | Duet temperature °C. | WR (according to DIN 53 814 in %) | Helium density g/cc | Hg-density g/cc | Porosity % |
|---|---|---|---|---|---|---|---|---|
| 2 | 4.80 | none | none | 105 | 171 | 1.18 | 0.453 | 61.6 |
| 3 | 3.25 | none | none | 105 | 151 | 1.18 | 0.490 | 58.5 |

TABLE I-continued

| No. | Quantity of water vapour in kg per kg of spun material | Quantity of air ($m^3/h$) | Air temperature °C. | Duet temperature °C. | WR (according to DIN 53 814 in %) | Helium density g/cc | Hg-density g/cc | Porosity % |
|---|---|---|---|---|---|---|---|---|
| 4 | 3.25 | 10 | 150 | 105 | 127 | 1.18 | 0.567 | 52.0 |
| 5 | 6.5 | 10 | 150 | 105 | 134 | 1.19 | 0.553 | 53.5 |
| 6 | 6.5 | 10 | 150 | 140 | 45 | 1.18 | 0.788 | 33.2 |
| 7 | 6.5 | none | none | 140 | 64 | 1.19 | 0.674 | 43.4 |
| 8 | 1.6 | none | none | 105 | 127 | 1.18 | 0.573 | 51.4 |

EXAMPLE 9

53.8 kg of dimethyl formamide were mixed with 20.2 kg of glycerol at room temperature in a vessel. Thereafter 26.0 kg of an acrylonitrile copolymer having the same chemical composition as in Example 1 were added with stirring and the suspension obtained was dissolved, filtered and dry spun in the same way as described in Example 1. The ratio by weight of polymer solids to non-solvent amounted to 1.3:1. 30 kg/hour of saturated water vapour were blown into the spinning duct above the spinning jet. The duct temperature was 105° C. Approximately 4.8 kg of water vapour were consumed per kg of spun material produced. The filaments having an overall denier of 2280 were after-treated in the same way as in Example 1 to form fibres having a final individual denier of 2.2 dtex. The fibres had a water retention capcity of 225%. They again showed a pronounced core-jacket structure with an oval to trilobal cross-section. The individual fibres had a helium density of 1.18 g/cc and a mercury density of 0.438 g/cc. Their porosity amounted to 62.9%.

Further Examples in which the ratio by weight of polymer solids to non-solvent was varied are summarised in Table II below. The spinning solutions were spun to form core-jacket fibres having a final denier of 2.2 dtex which were after-treated in the same way as described in Example 1. The acrylonitrile copolymer described in Example 1 was used as the polymer solids. 40 kg/h of saturated water vapour were blown into the spinning duct above the spinning jet.

TABLE II

| No. | Composition of the spinning solution (% by weight) Polyacrylonitrile | Glycerol | Dimethyl formamide | Ratio of polymer solids to non-solvent | WR (according to DIN 53814 in %) | Helium density g/cc | Hg-density g/cc | Porosity % |
|---|---|---|---|---|---|---|---|---|
| 10 | 19 | 19 | 62 | 1:1 | 260 | 1.18 | 0.402 | 65.9 |
| 11 | 24 | 24 | 52 | 1:1 | 243 | 1.18 | 0.426 | 63. |
| 12 | 26 | 13 | 61 | 2:1 | 103 | 1.18 | 0.559 | 52.6 |
| 13 | 28.6 | 11.4 | 60 | 2.5:1 | 72 | 1.18 | 0.713 | 39.6 |
| 14 | 33.3 | 6.7 | 60 | 5:1 | 34 | 1.18 | 0.831 | 29.5 |

As can be seen from the Table, water retention values of more than 100% and density values of less than 0.7 g/cc are obtained when the ratio of polymer solids to non-solvents amounts to at most about 2:1.

EXAMPLE 15

41.2 kg of dimethyl formamide were mixed with 8.4 kg of DL-sorbose at room temperature in a vessel. 10.6 kg of an acrylonitrile copolymer having the same chemical composition as in Example 1 were then added with stirring and the resulting suspension was dissolved, filtered and dry spun in the same way as in Example 1. The ratio by weight of polymer solids to non-solvent amounted to 1.3:1. 40 kg/h of saturated water vapour were blown into the spinning duct above the spinning jet. The duct temperature amounted to 105° C. Approximately 6.5 kg of water vapour were used per kg of spun material produced. The filaments which had an overall denier of 2280 dtex were after-treated in the same way as described in Example 1 to form fibres having a final individual denier of 2.2 dtex. The fibres had a water retention capacity of 213%. They had a pronounced core-jacket structure with an almost round cross-section. The individual fibres had a helium density of 1.18 g/cc and a mercury density of 0.477 g/cc. The porosity of the cottonwool-like, heavily matted fibres amounted to 59.6%.

We claim:

1. A process for the production of hydrophilic core-jacket low-density filaments or fibres of polyacrylonitrile having a porousity of at least 50%, water retention capacity of at least 100%, and a mercury density of at most 0.7 $g/cm^3$ of a hydrophilic, filament-forming synthetic polyacrylonitrile which comprises dry spinning the polymer, there being added to the spinning solvent a substance which:

(a) has a higher boiling point than the spinning solvent used, (b) is readily miscible with the spinning solvent and with water, and (c) is a non-solvent for the polymer to be spun, the ratio by weight of polymer solids to non-solvent amounts to at most 2:1;

and, immediately after the filaments leave the spinning jet or at the latest at a time at which they have still not completely hardened, bringing the filaments into contact at a duct temperature of at most 140° C. with steam.

2. The process of claim 1, wherein the steam is blown into the spinning duct in the spinning direction above the spinning jet.

3. A process according to claim 1, wherein the duct temperature is 105° to 125° C.

* * * * *